US010278429B2

(12) United States Patent
Gao et al.

(10) Patent No.: US 10,278,429 B2
(45) Date of Patent: May 7, 2019

(54) TEMPERATURE CONTROL SYSTEM OF E-CIGARETTE

(71) Applicant: O-NET AUTOMATION TECHNOLOGY (SHENZHEN) LIMITED, Shenzhen, Guangdong (CN)

(72) Inventors: Jianjie Gao, Guangdong (CN); Yongquan Zhou, Guangdong (CN); Bo Zhou, Guangdong (CN); Fei Shen, Guangdong (CN)

(73) Assignee: O-NET AUTOMATION TECHNOLOGY (SHENZHEN) LIMITED, Shenzhen (CN)

( * ) Notice: Subject to any disclaimer, the term of this patent is extended or adjusted under 35 U.S.C. 154(b) by 0 days.

(21) Appl. No.: 15/957,891

(22) Filed: Apr. 19, 2018

(65) Prior Publication Data

US 2018/0235282 A1 Aug. 23, 2018

Related U.S. Application Data

(63) Continuation of application No. PCT/CN2015/099082, filed on Dec. 27, 2015.

(30) Foreign Application Priority Data

Nov. 6, 2015 (CN) ..... 2015 2 0883156 U

(51) Int. Cl.
*A24F 47/00* (2006.01)
*H05B 1/02* (2006.01)

(52) U.S. Cl.
CPC ..... *A24F 47/008* (2013.01); *A24F 47/00* (2013.01); *H05B 1/0297* (2013.01)

(58) Field of Classification Search
CPC ..... A24F 47/008; H02J 7/0021; H02J 7/021; H02J 7/0024; H02J 7/0047; H02J 7/0072;
(Continued)

(56) References Cited

U.S. PATENT DOCUMENTS 7,540,286 B2 * 6/2009 Cross ..... A61M 15/0045 128/204.17
9,949,507 B2 * 4/2018 Flick ..... A24F 47/008
(Continued)

FOREIGN PATENT DOCUMENTS

CN 204440191 U 7/2015

OTHER PUBLICATIONS

International Search Report of PCT Patent Application No. PCT/CN2015/099082 dated Jul. 22, 2016.

*Primary Examiner* — Mark H Paschall

(57) ABSTRACT

The present invention relates to an temperature control system of an e-cigarette, which includes a power supply, a liquid guiding member, and a heating element, and further includes an operating voltage input unit separately connected to the power supply and the heating element, a temperature detection unit including a voltage detection module and a temperature processing module that are connected to each other, and an operating voltage adjusting unit separately connected to the temperature processing module and the heating element. According to the present invention, a temperature of the heating element is controlled by using the temperature control system. This avoids the following problems: When the e-cigarette operates, because the temperature of the heating element increases with a longer operating time, the liquid guiding member is burnt or e-liquid molecules are cracked to produce a burnt taste, thereby affecting human health as well as smoke taste and user experience.

11 Claims, 3 Drawing Sheets

(58) Field of Classification Search
CPC .. H02J 7/345; H05B 3/20; H05B 1/02; H05B 2213/04; H05B 1/0252; H05B 2203/021
USPC ..... 219/494, 497, 505, 492, 507, 483–486
See application file for complete search history.

(56) References Cited

U.S. PATENT DOCUMENTS

| | | | | |
|---|---|---|---|---|
| 9,968,135 | B2 * | 5/2018 | Liu | A24F 47/008 |
| 9,980,518 | B1 * | 5/2018 | Most | A24F 47/008 |
| 9,993,602 | B2 * | 6/2018 | Davidson | A61K 9/007 |
| 10,031,183 | B2 * | 7/2018 | Novak, III | G01R 31/327 |

* cited by examiner

TEMPERATURE CONTROL SYSTEM OF E-CIGARETTE

CROSS-REFERENCE TO RELATED APPLICATIONS

The present application is a Continuation Application of PCT application No. PCT/CN2015/099082 filed on Dec. 27, 2015, which claims the benefit of Chinese Utility Model Application No. 201520883156.9 filed on Nov. 6, 2015. The contents of all of the above are hereby incorporated by reference.

TECHNICAL FIELD

The present invention relates to the technical field of e-cigarettes, in particular to a temperature control system of an e-cigarette.

BACKGROUND

E-cigarettes, also known as electronic cigarettes, are mainly used to quit smoking and replace tobacco cigarettes. The e-cigarettes have similar appearance and taste to the tobacco cigarettes, but generally do not contain tar, suspended particles, and other harmful components found in the tobacco cigarettes. The e-cigarettes do not produce pervasive or lingering secondhand smoke. The e-cigarette is mainly composed of an atomizer and a power supply assembly. Usually, the atomizer includes a liquid storage tank, a heating element, and so on.

A liquid guiding member used for guiding e-liquid to the heating element is disposed between the heating element and the liquid storage tank, so that the e-liquid is distributed around and on the surface of the heating element and is heated by the heating element to produce an aerosol, and the liquid guiding member is generally made of a cotton material.

The e-cigarette usually heats and atomizes the e-liquid in the liquid storage tank by using the heating element, to produce an aerosol for a smoker. Increasing power of the e-cigarette decreases a resistance value of the heating element. When the e-cigarette operates, if a temperature of the heating element becomes higher as an electrifying time elapses, the liquid guiding member is prone to scorch due to the high temperature of the heating element and generate a burnt taste and a substance harmful to the human body. This not only affects the human health but also affects the aerosol taste. In addition, the heating element may be easily broken, shortening a service life of the heating element; the e-liquid exposed to the high temperature may even burst and injure an oral cavity of a user, affecting user experience of the e-cigarette.

SUMMARY

In view of the foregoing defects in the prior art, the technical issue to be resolved by the present invention is to provide a temperature control system of an e-cigarette, so as to resolve a problem of an excessively high temperature of a heating element.

The technical solution used by the present invention to resolve the technical issue thereof is to provide a temperature control system of an e-cigarette, including a power supply and a heating element, and further including:

an operating voltage input unit, where the operating voltage input unit is separately connected to the power supply and the heating element, and the operating voltage input unit converts original voltage input by the power supply into first operating voltage and supplies power to the heating element;

a temperature detection unit, where the temperature detection unit includes a voltage detection module and a temperature processing module that are connected to each other, the voltage detection module is connected to the heating element, the voltage detection module detects and sends voltage information of the heating element to the temperature processing module, and the temperature processing module converts the voltage information into a heating temperature; and an operating voltage adjusting unit, where the operating voltage adjusting unit is separately connected to the temperature processing module and the heating element, and the operating voltage adjusting unit converts the original voltage input by the power supply into second operating voltage, and selectively supplies power to the heating element according to the heating temperature.

Herein, in an example of the solution, the voltage detection module includes a signal amplification circuit, and the signal amplification circuit is separately connected to the temperature processing module and the heating element.

Herein, in an example of the solution, the temperature processing module includes a temperature threshold, the temperature processing module compares the converted-to heating temperature with the temperature threshold to obtain a comparison result, and the operating voltage adjusting unit selectively supplies power to the heating element according to the comparison result.

Herein, in an example of the solution, the operating voltage adjusting unit includes a voltage output module and a switch control module, the switch control module is connected to the temperature processing module, the voltage output module is separately connected to the switch control module and the heating element, and the switch control module controls the voltage output module according to the heating temperature to selectively supply power to the heating element.

Herein, in an example of the solution, the operating voltage adjusting unit further includes a voltage adjusting module, the voltage adjusting module is connected to the voltage output module, and the voltage adjusting module is configured to adjust a voltage value of the voltage output module.

Herein, in an example of the solution, the voltage adjusting module is a PWM module.

Herein, in an example of the solution, the temperature control system further includes a power supply voltage detection unit, where the power supply voltage detection unit is disposed between the power supply and the operating voltage input unit.

Herein, in an example of the solution, the temperature control system further includes a temperature control switch, where the temperature control switch is connected to the power supply, and the temperature control switch is configured to control ON or OFF of the temperature control system.

Herein, in an example of the solution, an airflow control unit connected to the temperature control switch is further included, and the airflow control unit is configured to identify and determine whether there is a negative pressure generated by air flow.

Herein, in an example of the solution, the temperature control switch further includes an airflow control unit connected to the temperature control system, and the airflow control unit is configured to identify and determine whether there is a negative pressure generated by air flow.

The beneficial effects of the present invention lie in that: compared with the prior art, the present invention designs a temperature control system of an e-cigarette and a temperature of a heating element is controlled by using a temperature control system, so that the temperature of the heating element remains within a proper range. This avoids the following problems: When the e-cigarette operates, because the temperature of the heating element increases with a longer operating time, the liquid guiding member is burnt or e-liquid molecules are cracked to produce a burnt taste and a substance harmful to the human body, and the human body inhales the burnt taste and the substance that are mixed with aerosol, thereby affecting human health as well as smoke taste and user experience; in addition, the heating element is burnt due to the excessively high temperature of the heating element, shortening a service life of the e-cigarette or the heating element, and the e-liquid exposed to the high temperature may burst and injure an oral cavity of a user.

BRIEF DESCRIPTION OF DRAWINGS

The present invention is further described with reference to the embodiments and the accompany drawings in which.

DESCRIPTION OF EMBODIMENTS

Herein, examples of the embodiments of the present invention are described in detail with reference to the accompanying drawings.

Figure 1:
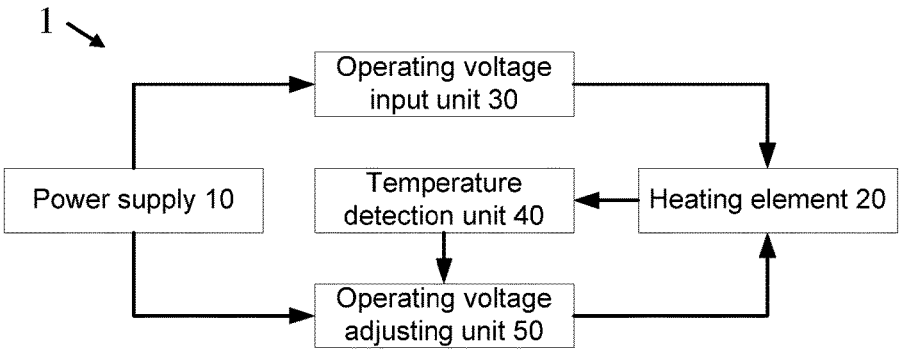
FIG. 1 is a structural block diagram 1 of a temperature control system according to the present invention.
Figure 2:
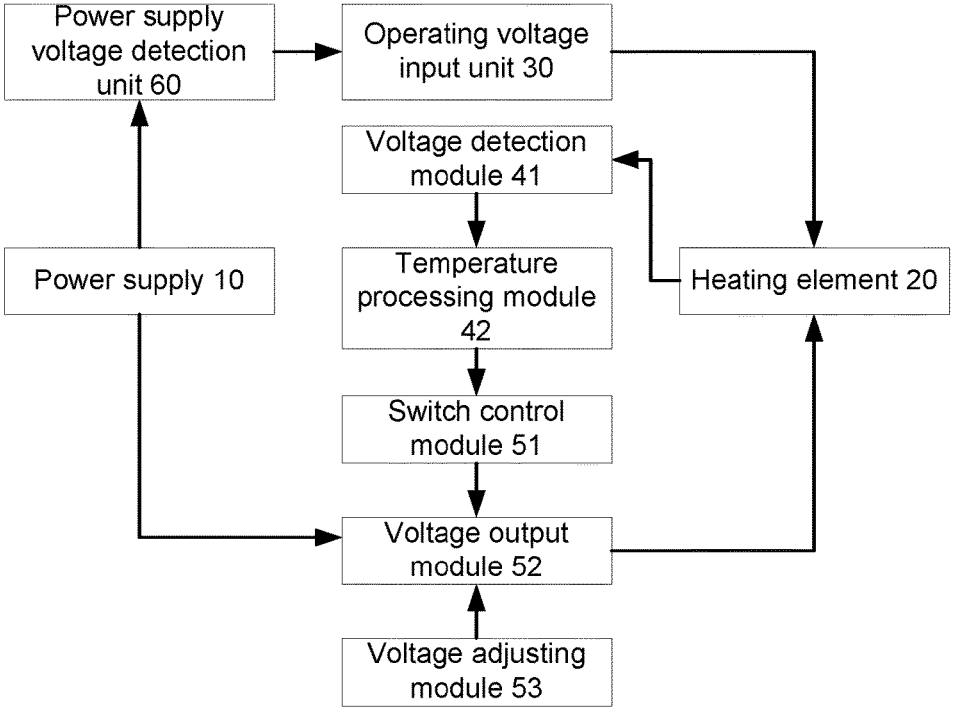
FIG. 2 is a structural block diagram 2 of a temperature control system according to the present invention.

As shown in FIG. 1 and FIG. 2, the present invention provides a preferred embodiment of a temperature control system.

A temperature control system 1 of an e-cigarette includes a power supply 10 and a heating element 20, and further includes an operating voltage input unit 30, a temperature detection unit 40, and an operating voltage adjusting unit 50. The operating voltage input unit 30 is separately connected to the power supply 10 and the heating element 20, the temperature detection unit 40 includes a voltage detection module 41 and a temperature processing module 42 that are connected to each other, and the voltage detection module 41 is connected to the heating element 20. The operating voltage adjusting unit 50 is separately connected to the temperature processing module 42 and the heating element 20.

Specifically,

In this embodiment, the operating voltage input unit 30 converts original voltage input by the power supply 10 into first operating voltage and supplies power to the heating element 20. In addition, the heating element 20 is heated at the first operating voltage, and e-liquid in the e-cigarette is heated and atomized by the heating element 20 to produce an aerosol for a smoker. That is, the power supply 10, the operating voltage input unit 30, and the heating element 20 form a simplest and most basic circuit structure.

Further, the temperature control system 1 further includes a power supply voltage detection unit 60, where the power supply voltage detection unit 60 is disposed between the power supply 10 and the operating voltage input unit 30. The power supply voltage detection unit 60 detects voltage V1 of the power supply 10, and a voltage threshold V0 is set in the power supply voltage detection unit 60. The power supply voltage detection unit 60 performs determining based on V1 and V0. If V0>V1, the power supply voltage detection unit 60 outputs the voltage V1; otherwise, the power supply voltage detection unit 60 outputs the voltage V0. This prevents another unit module of the temperature control system 1 from being burnt.

Further, the operating voltage input unit 30 further includes several current processing circuits, such as a rectifying circuit and a filtering circuit, so as to improve stability and accuracy of voltage that is output to the heating element 20.

In this embodiment, the voltage detection module 41 detects and sends voltage information of the heating element 20 to the temperature processing module 42, and the temperature processing module 42 converts the voltage information into a heating temperature.

The operating voltage input unit 30 includes a resistor R1, the output voltage of the operating voltage input unit 30 is V2, an internal resistance of the heating element 20 is set to R0, and a voltage signal detected by the voltage detection module 41 is set to V3. In this case, V3=V2−V2*R0/(R1+R0), where R0 varies with a heating status of the heating element 20.

Further, the temperature processing module 42 includes a temperature threshold. The temperature processing module 42 compares the converted-to heating temperature with the temperature threshold to obtain a comparison result, and the operating voltage adjusting unit 50 selectively supplies power to the heating element 20 according to the comparison result. The temperature threshold is set to T0, and the temperature processing module 42 converts the voltage information into the heating temperature T1. If T1>T0, the operating voltage adjusting unit 50 is turned off, and the heating element 20 is powered only by the operating voltage input unit 30, so that power of the heating element 20 is decreased, that is, the temperature of the heating element 20 is decreased. A temperature status of the heating element 20 continues to be monitored in real time. If T1<T0, the operating voltage adjusting unit 50 is turned on, and the operating voltage adjusting unit 50 outputs voltage to the heating element 20. In this case, the operating voltage input unit 30 is turned off, so that the power of the heating element 20 is increased, that is, the temperature of the heating element 20 is increased. The temperature status of the heating element 20 continues to be monitored in real time.

The foregoing operation is performed repeatedly, so that the temperature of the heating element 20 remains within a proper range until a puffing operation is stopped, thereby implementing intelligent temperature control. This avoids the following problems: When the e-cigarette operates, because the temperature of the heating element increases with a longer operating time, the liquid guiding member is burnt or e-liquid molecules are cracked to produce a burnt taste and a substance harmful to the human body, and the human body inhales the burnt taste and the substance that are mixed with aerosol, thereby affecting human health as well as smoke taste and user experience.

In this embodiment, the operating voltage adjusting unit 50 converts the original voltage output by the power supply 10 into second operation voltage, and selectively supplies power to the heating element 20 according to the heating temperature.

An operating status of the operating voltage adjusting unit 50 has been clearly described above and details are not described herein again.

Further, the operating voltage adjusting unit 50 includes a voltage output module 52 and a switch control module 51. The switch control module 51 is connected to the temperature processing module 42, and the voltage output module 52 is separately connected to the switch control module 51 and the heating element 20. The switch control module 51 controls the voltage output module 52 according to the heating temperature to selectively supply power to the heating element 20.

Further, the operating voltage regulating unit 50 further includes a voltage adjusting module 53. The voltage adjusting module 53 is connected to the voltage output module 52 and the voltage adjusting module 53 is configured to adjust a voltage value of the voltage output module 52. If T1 is much less than T0, the voltage adjusting module 53 may adjust the output voltage value of the voltage output module 52 to be larger. If T1 is slightly less than T0, the voltage adjusting module 53 adjusts the output voltage value of the voltage output module 52 to be smaller, so that T1 gradually approaches T0.

Figure 3:
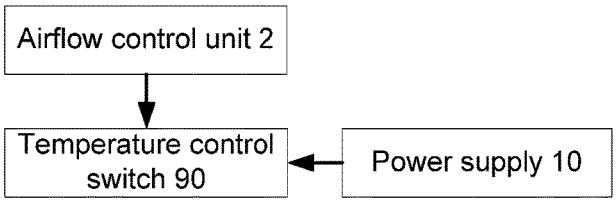
FIG. 3 is a structural block diagram of a temperature control switch and an airflow control unit according to the present invention.

As shown in FIG. 3, the present invention provides an example of an embodiment of a temperature control switch and an airflow control unit.

The temperature control system 1 further includes a temperature control switch 90. The temperature control switch 90 is connected to the power supply 10, and the temperature control switch 90 is configured to control ON or OFF of the temperature control system 1. In addition, the temperature control switch 90 is connected to the operating voltage input unit 30 and the operating voltage adjusting unit 50, and is configured to control connection between the operating voltage input unit 30 and the power supply 10 and control connection between the operating voltage adjusting unit 50 and the power supply 10.

The temperature control system 1 further includes an airflow control unit 2 connected to the temperature control switch 90. The airflow control unit 2 is configured to identify and determine whether there is a negative pressure generated by air flow. Preferably, the airflow control unit 2 controls operation of the temperature control switch 90. If the airflow control unit 2 detects a negative pressure generated by air flow, the airflow control unit 2 controls the temperature control switch 90 to turn on the temperature control switch 90, so that the operating voltage input unit 30 and the operating voltage adjusting unit 50 are electrically connected to the power supply 10 and the temperature control system 1 is started. If the airflow control unit 2 detects no air flow, to be specific, no negative air pressure is generated, the airflow control unit 2 controls the temperature control switch 90 to turn off the temperature control switch 90, so that the operating voltage input unit 30 and the operating voltage adjusting unit 50 are disconnected from the power supply 10 and the temperature control system 1 is turned off.

Alternatively, the e-cigarette includes an airflow control unit 2 connected to the temperature control system 1, that is, the airflow control unit 2 and the temperature control system 1 are two functional units. Further, the airflow control unit 2 controls operation of the temperature control system 1.

Specific operating manners are: 1. Perform puffing, so that the airflow control unit 2 identifies and determines that there is a negative pressure generated by air flow. 2. The airflow control unit 2 controls the temperature control switch 90 to turn on the temperature control switch 90, so as to start the temperature control system 1 and heat the heating element 20, thereby implementing intelligent temperature control. 3. Stop puffing, so that the airflow control unit 2 determines that no negative pressure is generated by air flow. 4. The airflow control unit 2 controls the temperature control switch 90 to turn off the temperature control switch 90, so as to turn off the temperature control system 1.

In this embodiment, the temperature control system 1 further includes a reset circuit. The circuit automatically enters a reset state after the operation is stopped for the first time. The circuit is normally connected during the second use.

Figure 4:
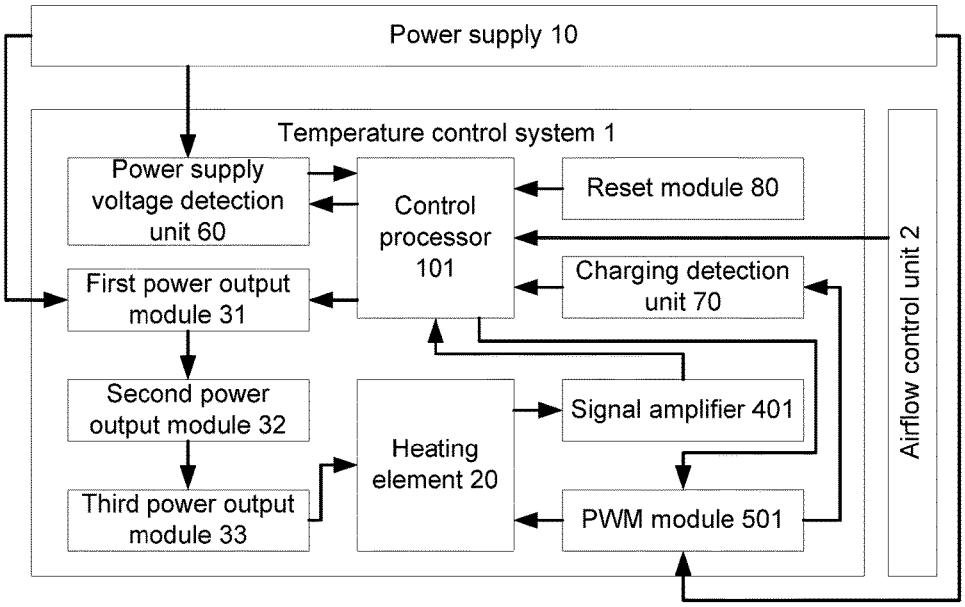
FIG. 4 is a circuit block diagram 1 of a temperature control system and an airflow control unit according to the present invention.
Figure 5:
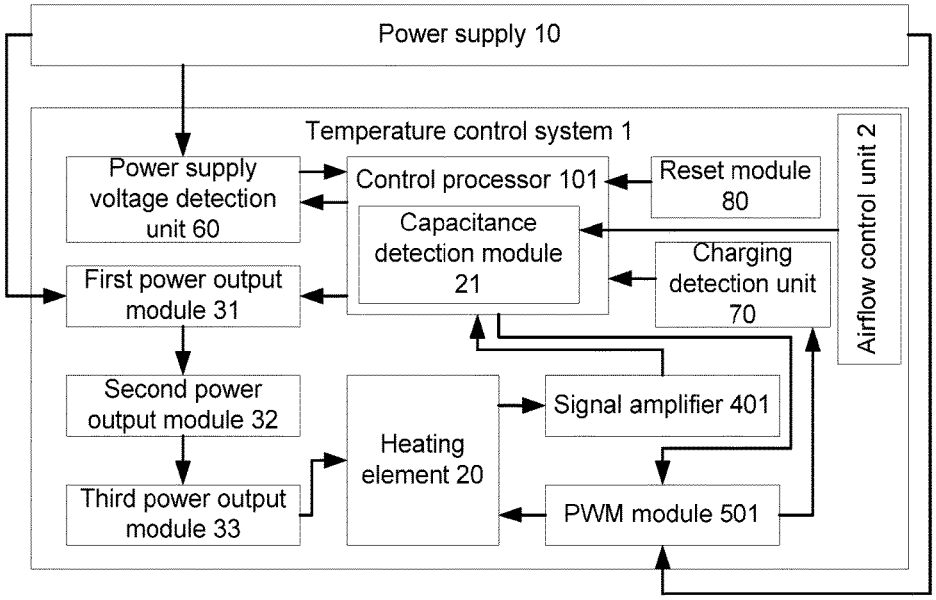
FIG. 5 is a circuit block diagram 2 of a temperature control system and an airflow control unit according to the present invention.

As shown in FIG. 4 and FIG. 5, the present invention provides an example of an embodiment of a circuit structure of a temperature control system and an airflow control unit.

A temperature control system 1 of an e-cigarette includes a power supply 10 and a heating element 20, and further includes a control processor 101, a first power output module 31, a second power output module 32, a third power output module 33, a signal amplifier 401, a PWM module 501, a power supply voltage detection unit 60, a charging detection unit 70, and a reset module 80. The e-cigarette further includes an airflow control unit 2 connected to the temperature control system 1.

The control processor 101 is a central processing unit, and is configured to implement functions of processing data, controlling related circuits, and the like. Preferably, the functions of the temperature processing module 42 and the switch control module 51 are integrated in the control processor 101, and the power supply voltage detection unit 60 is disposed between the power supply 10 and the control processor 101

The first power output module 31, the second power output module 32, and the third power output module 33 are disposed between the power supply 10 and the heating element 20. The first power output module 31 is connected to the power supply 10, and the first power output module 31 converts voltage of the power supply 10 into output voltage VA, the second power output module 32 converts the voltage VA into output voltage VB, and the third power output module 33 converts the voltage VB into output voltage VC, where VB>VC. The first power output module 31 is also connected to the control processor 101, the control processor 101 controls an operating status of the first power output module 31, or the second power output module 32 is connected to the control processor 101, or the third power output module 33 is connected to the control processor 101.

The signal amplifier 401 detects and transmits a voltage signal of the heating element 20 to the control processor 101, to improve detection accuracy. The signal amplifier 401 is equivalent to the foregoing voltage detection module 41.

The PWM module 501 is disposed between the power supply 10 and the heating element 20. The PWM module 501 is also connected to the control processor 101, and the control processor 101 controls an operating status, such as OFF or ON, of the PWM module 501. The PWM module 501 is equivalent to the foregoing operating voltage adjusting unit 50. The charging detection unit 70 is disposed between the PWM module 501 and the control processor 101.

Both the airflow control unit 2 and the reset module 80 are connected to the control processor 101

Further, if the airflow control unit 2 is disposed inside the temperature control system 1, a capacitance detection module 21 is disposed in the control processor 101. The capacitance detection module 21 is configured to detect a puff status and send puff information to the control processor 101, and the control processor 101 makes analysis and determining on the puff information and controls operation of other functional units.

If the airflow control unit 2 is disposed outside the temperature control system 1, the airflow control unit includes a capacitance detection module 21. The capacitance detection module 21 sends detected puff information to the airflow control unit 2, and the airflow control unit 2 makes analysis and determining on the puff information and controls operation of the temperature control system 1.

Further, if the airflow control unit 2 is disposed outside the temperature control system 1, the capacitance detection module 21 is disposed in the airflow control unit 2. If the airflow control unit 2 is disposed in the temperature control system 1, the capacitance detection module 21 is integrated in the control processor 101, thereby implementing an integrated design. To be specific, the airflow control unit 2 is integrated in the temperature control system 1, so that the airflow control unit 2 has a simple structure, complete functions, and a small size and is easy to carry.

Further, the temperature control system 1 further includes the charging detection unit 70. The charging detection unit 70 is connected to the control processor 101. Preferably, the charging detection unit 70 is also connected to the power supply 10 indirectly or directly, so as to charge the power supply 10. When the e-cigarette is being charged, the charging detection unit 70 analyzes and determines whether input voltage is charging voltage and then makes a corresponding instruction. If the charging detection unit 70 detects that the input voltage is charging voltage, the power supply 10 is charged; otherwise, external voltage is stopped from connecting to the power supply 10.

In this embodiment, the charging detection unit 70 is connected to the power supply 10 by using the PWM module 501, so as to increase a utilization rate of the temperature control system 1.

The foregoing descriptions are merely examples of embodiments of the present invention and are not intended to limit the scope of the present invention. Any equivalent changes or modifications made according to the patent scope of the present invention are covered by the present utility mode.

What is claimed is:

1. A temperature control system of an e-cigarette, comprising a power supply and a heating element, a control processor;

an operating voltage input unit, wherein the operating voltage input unit is separately connected to the control processor, the power supply and the heating element, and the operating voltage input unit converts original voltage input by the power supply into first operating voltage for the heating element and supplies power to the heating element under control of the control processor;

a temperature detection unit, wherein the temperature detection unit comprises a voltage detection module and a temperature processing module that are connected to each other, the voltage detection module is connected to the heating element, the voltage detection module detects and sends voltage information of the heating element to the temperature processing module, and the temperature processing module converts the voltage information into a heating temperature; and an operating voltage adjusting unit, wherein the operating voltage adjusting unit is separately connected to the control processor, the power supply, the temperature processing module and the heating element, and the operating voltage adjusting unit converts the original voltage input by the power supply into second operating voltage for the heating element, and selectively supplies power to the heating element according to the heating temperature under control of the control processor, the temperature processing module comprises a temperature threshold, the temperature processing module compares a converted-to heating temperature with the temperature threshold to obtain a comparison result, and the control processor selectively controls the operating voltage input unit and the operating voltage adjusting unit to supply power to the heating element according to the comparison result.

2. The temperature control system according to claim 1, wherein the voltage detection module comprises a signal amplification circuit, and the signal amplification circuit is separately connected to the temperature processing module and the heating element.

3. The temperature control system according to claim 1, wherein the operating voltage adjusting unit further comprises a voltage output module and a voltage adjusting module, the voltage output module is connected to the heating element, the voltage adjusting module is connected to the voltage output module, and the voltage adjusting module is configured to adjust a voltage value of the voltage output module.

4. The temperature control system according to claim 3, wherein the voltage adjusting module is a PWM module.

5. The temperature control system according to claim 1, further comprising a power supply voltage detection unit, wherein the power supply voltage detection unit is disposed between the power supply and the operating voltage input unit; and the power supply voltage detection unit comprises a voltage threshold and detects voltage of the power supply, when the voltage threshold is greater than the voltage of the power supply, the power supply voltage detection unit outputs the voltage of the power supply; otherwise, the power supply voltage detection unit outputs the voltage threshold.

6. The temperature control system according to claim 1, further comprising a temperature control switch, wherein the temperature control switch is connected to the power supply, and the temperature control switch is configured to control ON or OFF of the temperature control system.

7. The temperature control system according to claim 6, further comprising an airflow control unit connected to the temperature control switch, wherein the airflow control unit is configured to identify and determine whether there is an air flow, and control ON or OFF of the temperature control switch.

8. The temperature control system according to claim 1, further comprising a reset module connected to the control processor.

9. The temperature control system according to claim 1, wherein the temperature processing module is integrated in the control processor.

10. The temperature control system according to claim 1, further comprising a charging detection unit separately connected to the control processor and the power supply; wherein the charging detection unit analyzes and determines whether an input voltage is a charging voltage and then makes a corresponding instruction.

11. The temperature control system according to claim 1, wherein when T1>T0, the operating voltage adjusting unit is turned off, and the heating element is powered only by the operating voltage input unit, where T1 is the converted-to heating temperature, and T0 is the temperature threshold; when T1<T0, the operating voltage input unit is turned off, and the operating voltage adjusting unit is turned on and outputs voltage to the heating element.

* * * * *